United States Patent [19]

Dietrich et al.

[11] Patent Number: 4,754,720

[45] Date of Patent: Jul. 5, 1988

[54] PROCESS AND DEVICE FOR FABRICATING SEAT COVERS

[75] Inventors: Herbert Dietrich, Kaiserslautern; Kurt Petry, Stelzenberg, both of Fed. Rep. of Germany

[73] Assignee: Pfaff Industriemaschinenen GmbH, Fed. Rep. of Germany

[21] Appl. No.: 116,622

[22] Filed: Nov. 3, 1987

[30] Foreign Application Priority Data

Dec. 3, 1986 [DE] Fed. Rep. of Germany ..... 3641345

[51] Int. Cl.[4] ..... D05B 21/00

[52] U.S. Cl. ..... 112/262.3; 112/121.26; 112/310; 112/132

[58] Field of Search ..... 112/121.26, 310, 303, 112/307, 132, 135, 262.3, 262.1

[56] References Cited

U.S. PATENT DOCUMENTS 2,045,363 6/1936 Mitchell ..... 112/121.23
2,132,429 10/1938 Mitchell ..... 112/121.23
2,183,429 12/1939 Mitchell ..... 112/121.23

FOREIGN PATENT DOCUMENTS 3304343 6/1984 Fed. Rep. of Germany .
509672 7/1939 United Kingdom ..... 112/121.23

*Primary Examiner*—H. Hampton Hunter
*Attorney, Agent, or Firm*—McGlew and Tuttle

[57] ABSTRACT

In the process for manufacture of seat covers with honeycomb cells, a plain and folded segment of a cover material is introduced by means of a fold forming traveler into a first of several grooves of a foam plastic panel and after the traveler is retracted, the fold of cover material is sewn to the foam panel. Then, a new segment of the cover material is folded back over the seam by the traveler in the direction of the adjacent second groove and, after forming a fold, is sewn in this groove. In the seat covers produced by this process, the seams are fully concealed by the cover material.

13 Claims, 4 Drawing Sheets

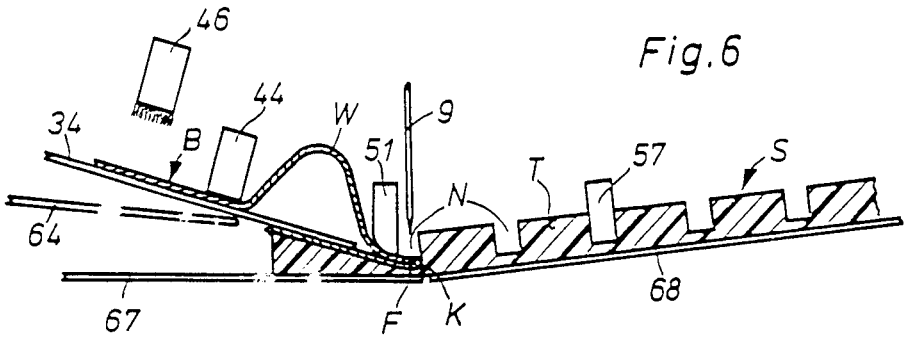
Fig. 6
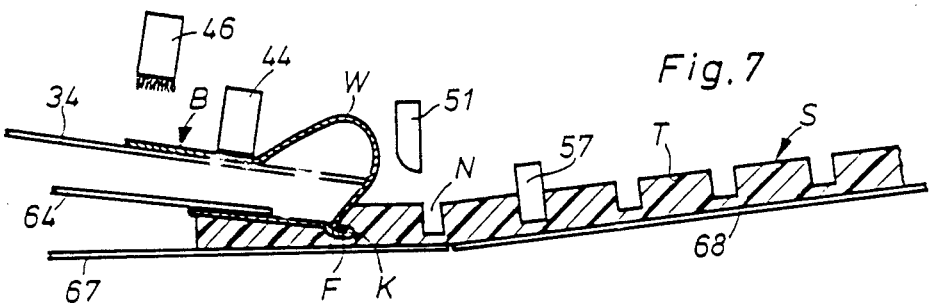
Fig. 7
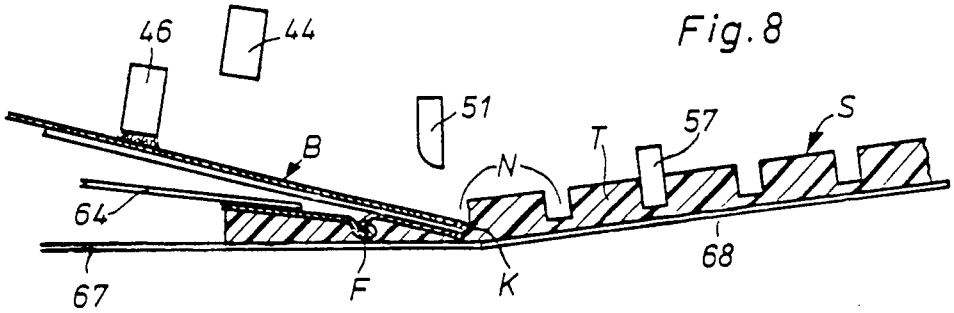
Fig. 8
Fig. 9
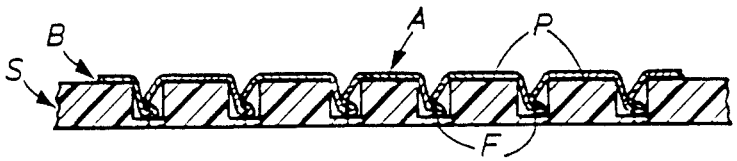

PROCESS AND DEVICE FOR FABRICATING SEAT COVERS

FIELD AND BACKGROUND OF THE INVENTION

This invention relates in general to the joining of composite parts into a finished product and in particular to a new and useful method of sewing a seat cover into a foamed plastic panel of honeycombed cells.

A similar process for fabrication of seat covers with honeycomb cells is described in German patent DE-PS No. 33 04 343, in which striplike segments of foam plastic provides the filling of cells. It is introduced between a lower piece of material and an upper piece of material by means of guide channels, the upper piece of material lying around the lengthwise edges of the segments of foam plastic. Then, the cells are simultaneously sewn up on a multiple needle sewing machine. With seat covers manufactured in this way, the two seams lying in each recess between two cells will always be openly visible, so that this process is not suitable for manufacture of seat covers with cells in which the seams are to be concealed for optical reasons or for better durability.

U.S. Pat. No. 2 183 249 indicates a machine for the manufacture of seat covers which comprises prefabricated upper material segments, a bottom material fed from a supply reel, and many striplike elastic insert pieces lying between the layers of material. The layers of material are folded riblike between the insert pieces and the edges of the fold project on the lower piece of material. Then, the projecting portion of the fold is sewn up with a blind stitch by an appropriate number of sewing heads at the same time, so that many adjoining padded cells are formed on the upper side of the finished seat cover and the seams are quite invisible.

A serious defect of the seat covers made in this way is the fact that the seams under prolonged and heavy use are permanently stretched, so that gaps are formed between the originally adjacent segments of upper material in the region of the seam and as a result the threads of the seam become visible.

SUMMARY OF THE INVENTION

The invention provides a process for the manufacture of seat covers with honeycomb cells in which the seams are fully concealed and the threads of the seam do not become visible, even under stretching of the seam.

By using a foam plastic panel provided with prefabricated grooves as the elastic cushioning material instead of individual striplike insert pieces, this process dispenses with the exact placement of insert pieces between the upper and lower layers of material. Since the foam plastic panel is provided with a glued backing, it possesses great form stability to begin with, and there is no need for it to be sewn to the bottom material.

By virtue of the fact that after each sewing procedure the cover material to be used in the next folding and sewing procedure is folded back over the previously formed seam, the seams are entirely concealed and even remain invisible when the seat cover or the seams are stretched.

The inventive process enables an automatic operation of the individual process steps. Prior to each feeding motion of a new fold segment of the cover material into a groove, a portion of the cover material lying on the fold forming traveler is pushed together into a loose wave, large enough so that during the feeding motion it is again pulled flat without exerting any sizeable tension on the segment of material connected to the previously produced seam. This avoids any moving or uneven shifting of the already sewn portion of the seat cover.

An advantageous aspect of the inventive process creates a precondition for the needle rail always to advance the exactly required length of cover material on the traveler. Preferably the already sewn portion of the seat cover is held fast during feeding motion of the folding blade, so that the already sewn portion of the seat cover is additionally secured against being moved or unevenly shifted.

Accordingly it is an object of the invention to provide an improved method to forming a seat cover or similar article by joining a cover to a panel of foam plastic material which has transversely and longitudinally extending raised foam plastic portions separated by recesses and which includes directing the cover material so that a folded edge is introduced into the first row of recesses, held in position there and sewn or otherwise secured while a further portion of the cover is formed into a loop which is directed into the next adjacent recess and over the top of the raised foam honeycomb cells and the next folded edge is joined to the panel by sewing it along the recess and including repeating the process until the complete cover and panel are joined together.

A further object of the invention is to provide an apparatus for effecting the sewing of seat covers which includes a base plate which has a cross rail cooperative therewith which facilitates the positioning of the foam plastic panel so that its alternate rows of recesses in raised portions are oriented in respect to a traveler plate which carries a cover material which is folded over an edge of the traveler plate and directed by the traveler plate into the first row of recesses between the raised honeycomb portions of the cells and located in position so that it may be sewn by reciprocating sewing needles and which further includes means for forming a loop on the traveler plate of the cover material of an extent which permits it to cover the next adjacent row of cells and including means to direct this traveler plate so that the next formed edge of the cover material is directed into the second row of recesses at which this edge is again sewn in position and in which the process is repeated until the complete cover is sewn to the panel.

A further object of the invention is to provide a machine which permits the placing of a foam plastic material in a precise orientation to permit joining of a cover thereto which is sewn into the panel along recesses formed between raised foam cells of the cover.

A further object of the invention is to provide an apparatus for forming seat covers which is simple in design, rugged in construction and economical to manufacture.

The various features of novelty which characterize the invention are pointed out with particularity in the claims and annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIGS. 3–8 are enlarged schematic sectional views of the inventive steps showing the principle of the successive work phases;

FIG. 9 is a sectional view of a finished seat cover.

DESCRIPTION OF THE PREFERRED EMBODIMENTS

Figure 1:
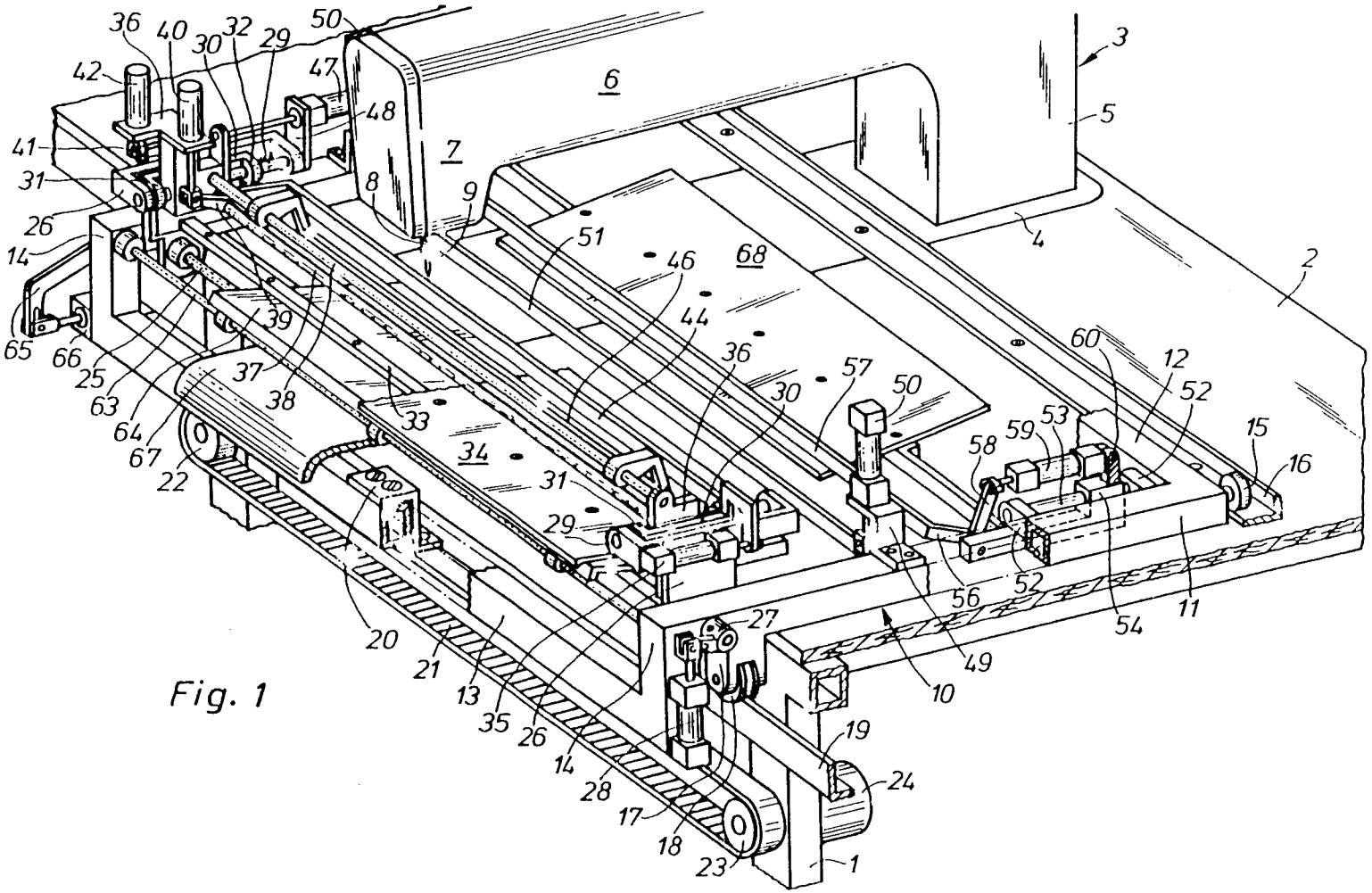
FIG. 1 is a partial top perspective view of a machine for the manufacture of seat covers constructed in accordance with the invention.

Referring to the drawings in particular, in accordance with the inventive method a seat cover assembly is formed with a foam plastic panel (S) which has a plurality of rows of transversely and longitudinally spaced raised cells designated (T) and recesses (N). In accordance with the invention the foam panel (S) is placed on a base plate (68) which includes a tilted base plate portion (67) and it is precisely oriented on plate (68) by means of a cross rail (57) which moves downwardly and enters into a selected recess (N) of the foam panel (S). The cover material (B) is fed onto a traveler (34) so that an edge overlaps the traveler and forms a joining edge (K) which is directed by movement by the traveler (34) to the first row of recesses (N). The cover material is then held by a holding plate which is moved onto the marginal edge of the cover which has been folded and a pressing member (51) is moved downwardly over the top of the first folded edge which is then sewn by a needle 9 which is positioned at the location of the recess (N).

In accordance with the invention the next length of cover material which is to be formed over the next raised cell (T) is formed by advancing a needle rail (44) along the cover material (B) to form a loop (W) which would be of a precise length to cover the next adjacent raised cell (T). Thereafter the traveler (34) is again moved to direct the next folded length of cover material into the next adjacent row of recesses (N). The material of the cover (B) is again held by the holding plate (64) and by the pressing rail (51) to effect a sewing in the next recess by the sewing needle (9). The base plates (67) and (68) are moved to position the material in the locations so that the sewing needle (9) is effective to sew along the recesses (N).

On a frame (1) there is secured to table top (2), which carries a sewing machine (3). The sewing machine (3) has a base plate (4), set into the table top (2), a pedestal (5), and an arm (6), which passes into a head (7). In the head (7) is a needle bar (8), carrying a needle (9), which is actuated in the usual manner, (not shown).

A naturally rigid frame (10) comprise two cross bars (11), a rear lengthwise bar (12) joining these together, and a front lengthwise bar (13), which is joined to the cross bars (11) across two short vertical bars (14). The frame (10) rests on an angle rail (16), secured to the table top (2) and extending transverse to the lengthwise direction of the sewing machine (3), across several traveling rolls (15) able to turn on the rear lengthwise bar. The frame (10) is further supported and at the same time guided by several profile rolls (18), each turning in a holder (17), on guide rails (19) fastened to the frame (1) and extending parallel to the angle rail (16), so that the frame (10) can move in the direction transverse to the lengthwise direction of the sewing machine (3). The frame (10) is connected to the upper segment of a toothed belt or gear belt (21) across an angle piece (20), fastened to the front lengthwise bar (13). The toothed belt (21) travels across two gear wheels (22, 23), one of which is connected to a drive motor (24).

On the two cross bars (11) there is arranged a rotating shaft (25) extending between these bars, and on the shaft there are fastened two carrier plates (26) adjacent to the cross bars (11). On one end of the rotating shaft (25) is secured a crank (27), which is coupled to the piston rod of a pneumatic cylinder (28), fastened to the frame (10). On the upper end of each carrier plate (26), fashioned as a fork, there is secured a slide rod (29), extending parallel to the cross bars (11). On each slide rod (29) is arranged a cradle (30), U-shaped in top view, which has two transversely projecting legs (31, 32). The two cradles (30) are solidly joined together by a rod (33). On the rod (33) is secured a fold forming traveler (34) in the shape of a plate. To move the traveler (34), there is a pneumatic cylinder (35) assigned to each cradle (30), of which for better visibility in FIGS. 1 and 2 only the pneumatic cylinder (35) of the right cradle (30) is shown.

On each of the two slide rods (29) there is arranged an additional movable cradle (36), which is shorter than the particular cradle (30) located on the same slide rod (29) and which is located between the two projecting legs (31, 32) of the latter. On the two cradles (36) there are arranged two rotating shaft (37, 38), which at the same time join these cradles together. The shaft (37) is connected by a crank (39), fastened to it, with the piston rod of a pneumatic cylinder (40), which is arranged on the left cradle (36) in FIGS. 1 and 2. The shaft (38) is joined by a crank (41), fastened to it, with the piston rod of a pneumatic cylinder (42), which is also arranged on the left cradle (36) in FIGS. 1 and 2.

On the rotating shaft (37) there are secured two arms (43) (FIG. 2), which carry a needle rail (44) that is moved up and down by the pneumatic cylinder (40). On the rotating shaft (38) there are secured two arms (45) (FIG. 2), which carry a brush rail (46) that is moved up and down by the pneumatic cylinder (42). The two cradles (36) on the slide rods (29) are moved by two pneumatic cylinders (47), of which for better visibility in FIGS. 1 and 2 only the pneumatic cylinder (47) of the left cradle (36) is shown. This pneumatic cylinder (47) is arranged on a holding plate (48) which, in turn is fastened to the adjacent carrier plate (26).

There is a pneumatic cylinder (50) arranged on each of the two angle pieces (49), fastened to the two cross bars (11). Arranged on the piston rods of the two pneumatic cylinders (50) is a pressing rail (51), extending transverse to the lengthwise direction of the sewing machine.

On each cross bar (11) there are arranged two shoulders (52), which carry a slide rod (53). On the slide rods (53) are arranged the cradles (54), each L-shaped from the side view. On the end of each cradle (54) facing the pressing rail (51) is a movably mounted arm (55 and 56). The free ends of the arms (55, 56) are joined together by a cross thrust rail (57), extending parallel to the pressing rail (51). The arm (56) is joined to a lever (58) in one piece. The lever (58) is engaged by the piston rod of a pneumatic cylinder (59), which is linked to a shoulder (60) of the corresponding cradle (54). The two cradles (54) are moved by two pneumatic cylinders (61), shown only in FIG. 2, which are fastened to the cross bars (11), the piston rods of the cylinders being connected to the side projections (62) of the cradles (54).

Figure 2:
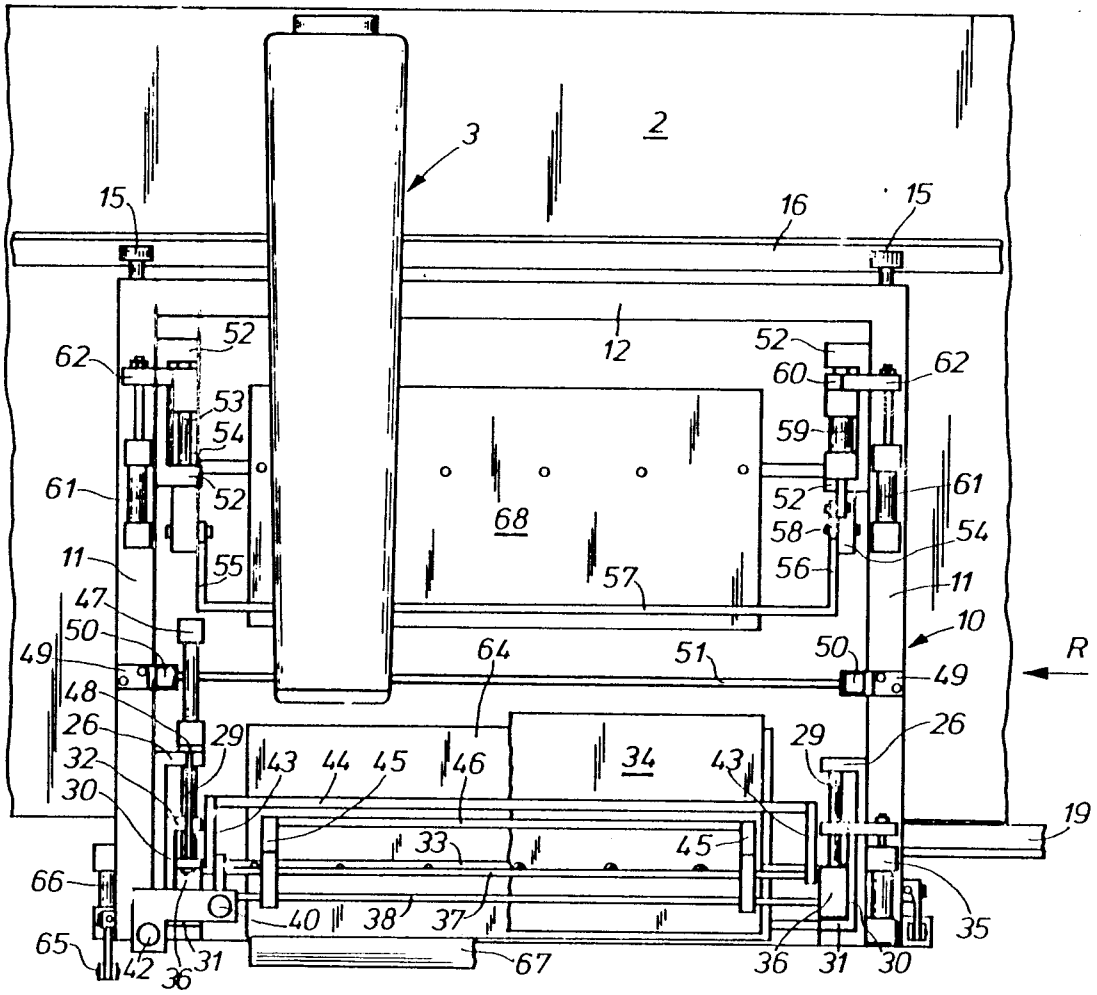
FIG. 2 is a top plan view of the machine.

Mounted on the front end of the two cross bars (11) and extending between them is a rotating shaft (63), shown only in FIG. 1, on which is secured a holding plate (64), extending basically in the horizontal direction. On one end of the shaft (63) is secured an angle lever (65), to which is coupled the piston rod of a pneumatic cylinder (66), arranged on the frame (10).

Arranged on the frame (10) are two base plates (67, 68), which have a small spacing from the table top (2). The front base plate (67), shown only in FIG. 1, extends beneath the holding plate (64) in basically the horizontal direction and has an upwardly curved section in its forward region. The rear base plate (68) is located beneath the cross thrust rail (57) and extends in a tilted plane.

The mode of operation is as follows:

On the base plate (68) there is placed a foam plastic panel (S), which contains a number of rectangular grooves (N) with an identical mutual spacing. The foam panel (S) is arranged as in FIG. 3 such that the third groove (N) is located beneath the cross thrust rail (57). After setting down the foam panel (S), the cross thrust rail (57) is lowered into the groove (N) lying beneath it by the pneumatic cylinder (59) and in this manner the foam panel (S) is secured to the base plate (68).

Figure 3:
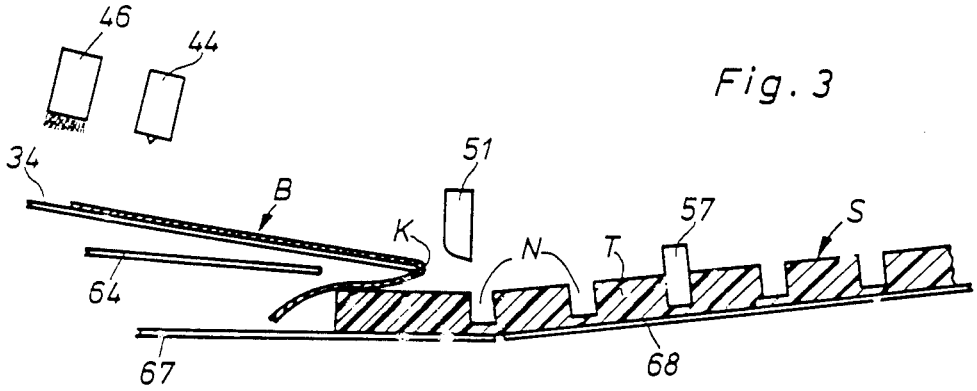

Then, a segment of cover material B with the intended upper side facing downward is placed on the raised traveler (34) and a segment projecting beyond the edge of the traveler as in FIG. 3, is placed beneath the raised holding plate (64) on the front part of the foam plastic panel (S).

After the placement of the cover material (B), the needle rail (44) is lowered onto the cover material (B) by the pneumatic cylinder (40), while the brush rail (46) is still kept in the raised position.

Then the travelers (34) is pushed beneath the pressing rail (51), held in the lifted position, by the pneumatic cylinder (35). As soon as the front edge of the traveler (34) is located above the first groove (N), it is moved down by the pneumatic cylinder (28). At the end of the swiveling and pushing motion of the traveler (34), the edge (K) of the fold of cover material (B) formed by its front edge, as in FIG. 4, lies in the corner of the groove (N) closer to the cross thrust rail (57), while the portion of the foam plastic panel bordering this groove (N) and facing the direction of the holding plate (64) is pressed flat.

During the pushing movement of the traveler (34), which occurs by the shifting motion of the respective cradles (30) on the particular slide rods (29), the cradles (36) arranged on the same slide rods between the legs (31, 32) of the cradles (30) are moved along from the start of the motion by the leg (31), acting as a driver in this respect, so that the rotating shafts (37, 38) arranged on the cradles (36) and the brush rail (46) are moved along in synchronization with the traveler (34).

Figure 4:
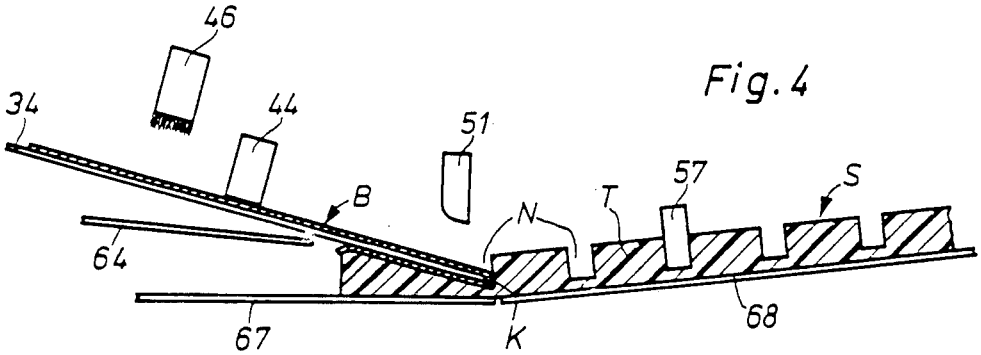

As soon as the traveler (34) reaches the end position shown in FIG. 4, the pressing rail (51) is lowered by the pneumatic cylinder (50) with light horizontal distance from the edge of the fold (K) onto the cover material (B) lying on the traveler (34). Then, by the pneumatic cylinder (47), the two cradles (36) are moved along the slide rode (29) in the direction of the pressing rail (51), until they come to stop against the legs (32) of the cradles (30). In this way, the needle rail (44) is pushed into the position on the traveler (34) shown in FIG. 5. As a result of this movement of the needle rail (44), the segment of cover material (B) gripped between the needle rail and the pressing rail (51) is pushed together into a loose wave (W).

After formation of the wave (W), the traveler (34) along with the needle rail (44) and the brush rail 946) is retracted to the position shown in FIG. 6.

Meanwhile, the cover material (B) is held firmly by the pressing rail (51), so that the edge (K) of the fold remains in the corner of the groove (N). Then, the motor of the sewing machine (3), which is not shown, and the drive motor (24) for the frame (10) are simultaneously activated, whereupon the fold of cover material (B) located in the groove (N) is joined to the foam plastic panel (S) by a seam (F) formed between the edge (K) of the fold and pressing rail (51).

After making the seam (F), the frame (10) is withdrawn into the starting position and the cross thrust rail (57) is swung up by the pneumatic cylinder (59) and moved back by the pneumatic cylinder (61) to the next, i.e., the fourth groove (N), after which the cross thrust rail (57) is swung down into this groove (N). Then, the traveler (34) and the pressing rail (51) are raised, upon which the cross thrust rail (57) pushes the foam panel (S) into the position shown in FIG. 7.

As soon as the foam panel (S) is in the new position, the holding plate (64) is swung down by the pneumatic cylinder (66), by which the portion of the cover material (B) lying between this plate and the base plate (67) and the foam panel (S) are pinched together and held fast. Then, the traveler (34) in its raised position is pushed by the pneumatic cylinder (35) underneath the raised pressing rail (51), whereby the segment of cover material (B) formed into a wave (W) on the traveler (34) is moved along over the groove (N) and the ridge (T) of the foam panel (S) situated between the first and the second groove (N) and thereby pulled flat. During this movement of the traveler (34), the pneumatic cylinders (47) hold the cradles (36) against the legs (32) of the cradles (30), whereby the needle rail (44) and the brush rail (46) are moved together with the traveler (34). As soon as the front edge of the traveler (34) is located above the second groove (N), the traveler (34), the needle rail (44) and the brush rail (46) are together swung downward by the pneumatic cylinder (28). At the end of the swinging and pushing motion of the traveler 934), the edge (K) of the fold of cover material (B) formed by the front edge of the traveler lies in the corner of the second groove (N) closer to the cross thrust rail (57), as in FIG. 8, while the portion of the foam panel (S) bordering this groove (N) and facing the holding plate (64) is pressed flat.

As soon as the traveler (34) reaches the end position shown in FIG. 8, the brush rail (46) is lowered by the pneumatic cylinder (42) onto the cover material (B) and the needle rail (44) is lifted by the pneumatic cylinder (40) enough so that it no longer pulls along the cover material (B). After this, the cradles are pushed by the pneumatic cylinder (47) along the slide rods (29) until they strike against the legs (31) of the cradles (30).

By this relative motion between the brush rail (46) and the cover material (B) held securely in the groove (N) by the traveler (34), the portion of cover material (B) lying on the traveler (34) is pulled completely flat and at the same time the edge (K) of the fold is also stretched taut. Subsequently, the needle rail (44) and the brush rail (46) are together retracted into their starting position shown in FIG. 3.

Figure 5:
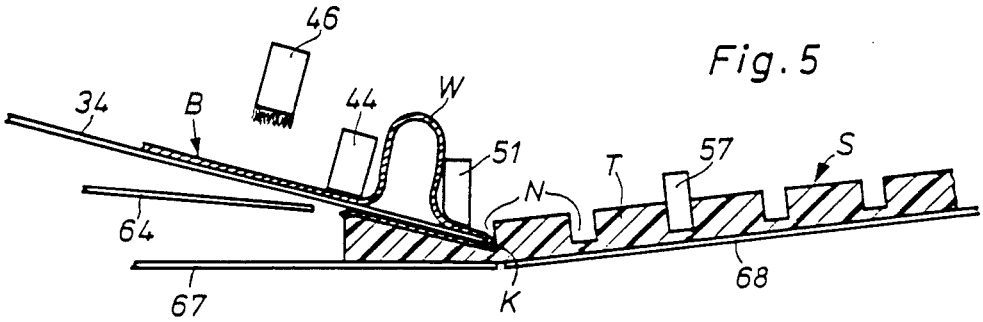

When the needle and the brush rails (44, 46) have reached their initial position, the pressing rail (51) is lowered again, as in FIG. 5, a new wave (W) is formed in the cover material (B) by the needle rail (44), and then the traveler (34) is retracted as shown in FIG. 6, whereupon the fold of cover material (B) located in the second groove (N) is connected to the foam panel (S) by a seam in the previously described manner.

With the formation of the second seam, the first foam plastic filled cell (P) of the seat cover (A) shown in FIG. 9 is complete. Subsequently, the folding movements of the cover material (B), the feeding movements of the foam panel (S), and the seams (N) necessary for the remaining cells (P) are carried out in the manner shown in FIGS. 5–8.

While specific embodiments of the invention have been shown and described in detail to illustrate the application of the principles of the invention, it will be understood that the invention may be embodied otherwise without departing from such principles.

What is claimed is:

1. A process for the fabrication of seat covers of a material and a plastic foam material comprising a plurality of honeycomb cell raised rows and recesses which extend transversely and longitudinally and which are enclosed by a cover material which is secured by seams running parallel to each other, comprising folding over a marginal edge of the cover material to form a folded edge, introducing the folded edge of the cover material into the first of the plurality of recesses of the foam plastic panel and arranging the cover material with a spacing the width of the cell, joining the cover material to the foam plastic panel along the edge of the fold by a seam running parallel with the edge, covering the next row of cells with the cover material by folding the cover material again to form a next fold edge, introducing the next fold edge into the second of the plurality of recesses sewing this next fold edge along the edge of the fold by a seam running parallel with the edge, and repeating the process to cover each cell in succession.

2. A process according to claim 1, including using a traveler plate on which the cover material is fed and upon which the cover material is folded which includes pushing the traveler plate so that its edge is against the folded edge of material and is directed into the first row of recesses, including grasping the material which is located in the groove by lowering the pressing rail onto the material at a spaced location from the edge of the fold and including removing the traveler form beneath the pressing rail, forming the seam by sewing along this seam and subsequently moving the traveler with a new length of cover material which is folded thereover directed into the next row of recesses.

3. A process according to claim 2, wherein the next length of material after the first length of material is formed by folding the edge of the cover material on the traveler plate is formed by pushing the material along the traveler plate until it forms into a loop of a length substantially equal to the length necessary to cover the next adjacent row of raised cells and direct the material into the recess beyond this next adjacent row.

4. A process according to claim 3, including stretching the layer of the material which lies on the traveler so that it is smooth before the folded over portion of the cover is engaged.

5. A process according to claim 4, including holding the first sewn portion of the material on the top of the cells of the panel during the further forward motion of the traveler after the initial edge is sewn to the panel.

6. A process of forming a seat cover of a foam plastic panel having a plurality of rows of transversely and longitudinally spaced raised cells and recesses and a cover, and using a support base plate and means for orienting the foam plastic panel in a precise position on the base plate and also using a traveler plate on which the cover is carried, comprising applying the cover onto the traveler plate so that a marginal cover edge is folded over the edge of the traveler plate, orienting the plastic panel so that the recesses between the rows of raised cell portions are at a predetermined distance from the traveler plate, moving the traveler plate so that the marginal cover edge is introduced into the first row of recesses, securing the cover material to the panel forming a securing seam of the cover to the panel along the first row of recesses, forming a loop of cover material by sliding material on the traveler toward the securing seam, and moving the traveler plate along the cover material and directing the cover material into the next row of recesses.

7. A process according to claim 6, wherein the material is secured by sewing a seam across the cover material and into the panel adjacent the folded over edge.

8. An apparatus for forming seat covers of a foam plastic panel having a plurality of rows of transversely and longitudinally spaced raised cells and recesses in a cover, comprising a support base plate upon which the foam plastic material placed, a movable traveler member overlying said base plate and over which the cover material is positioned leaving a marginal edge which is folded over the edge of the plate, cross rail member engageable into a recess of the plastic panel and orienting said panel on said base plate, for moving said traveler plate so as to position the folded over edge of the cover material into the first row of recesses, a holding plate between said base plate and said traveler plate being movable toward the folded over edge to engage the material overlying the first portion of the panel to hold it in position, a pressing rail movable above said base plate and over said cover and engageable with said cover to hold it in a position in which the edge engages in said recess, said orienting means being movable to move said panel along said base plate, and including needle rail member engageable over the cover on said traveling plate for pushing a length there of cover material in a direction toward the next adjacent recess.

9. An apparatus according to claim 8, wherein said needle rail is mounted for up and down movement over said plate and it may be moved in a pushing direction parallel to the plane of said traveler in a direction toward the next row of recesses, and sewing needle means operable to sew a seam along the cover material located in a fixed location for orientation over each recess in a row as if the panel is moved by said orienting means.

10. An apparatus according to claim 8, including a brush rail mounted over said base plate in a short distance from said needle rail being movable upwardly and downwardly as well as parallel to the plane of said traveler plate and transverse to the direction of said sewing needle.

11. A device according to claim 8, including a plurality of carrier plates, drive mechanism for swiveling said carrier plates including a sliding rod, a first pair of cradles mounted on said sliding rod which lifts up said traveler, a second pair of cradles, first revolving shaft on said second pair of cradles which carry said needle rail, and a second revolving shaft would carry said brush rails, said first pair of cradles being movable in either direction of a second drive mechanism connected to said first pair of cradles, said second pair of cradles being carried along in one direction of motion by said first pair of cradles being movable in the other direction.

12. A device according to claim 8, wherein the holding plate is arranged for movement upwardly and downwardly between said traveler and said base plate, said holding plate being engageable with the folded over piece of cover material to hold it in position as a new length of material is being formed on said traveler for movement in the next adjacent row of recesses.

13. A device according to claim 12, including a stationary sewing machine located to overlie said base plate at a fixed location and including a frame carrying said base plate permitting movement thereof so that said base plate with the panel and cover material may travel parallel to the direction of sewing.

* * * * *